US006206307B1

(12) United States Patent
Kelly et al.

(10) Patent No.: US 6,206,307 B1
(45) Date of Patent: Mar. 27, 2001

(54) ELECTROSTATIC ATOMIZER WITH CONTROLLER

(75) Inventors: Arnold J. Kelly, Princeton Junction, NJ (US); Frederick Prahl, Georgetown, TX (US)

(73) Assignee: Charged Injection Corporation, by said Arnold J. Kelly, Monmouth Junction, NJ (US)

( * ) Notice: Subject to any disclaimer, the term of this patent is extended or adjusted under 35 U.S.C. 154(b) by 0 days.

(21) Appl. No.: 09/430,633

(22) Filed: Oct. 29, 1999

Related U.S. Application Data

(60) Provisional application No. 60/106,421, filed on Oct. 30, 1998.

(51) Int. Cl.[7] ..... B05B 5/053
(52) U.S. Cl. ..... 239/690
(58) Field of Search ..... 239/690, 691, 239/708

(56) References Cited

U.S. PATENT DOCUMENTS

| | | | | |
|---|---|---|---|---|
| 4,255,777 | | 3/1981 | Kelly | 361/228 |
| 4,266,262 | * | 5/1981 | Haase, Jr. | 239/691 X |
| 4,380,786 | | 4/1983 | Kelly | 361/228 |
| 4,581,675 | | 4/1986 | Kelly | 361/228 |
| 4,630,169 | * | 12/1986 | Kelly | 239/690 |
| 4,846,407 | * | 7/1989 | Coffee et al. | 239/690 |
| 4,991,774 | | 2/1991 | Kelly | 239/3 |
| 5,093,602 | | 3/1992 | Kelly | 313/231.01 |
| 5,297,738 | * | 3/1994 | Haase, Jr. | 239/691 X |
| 5,378,957 | | 1/1995 | Kelly | 313/231.01 |
| 5,391,958 | | 2/1995 | Kelly | 313/420 |
| 5,478,266 | | 12/1995 | Kelly | 445/43 |
| 5,515,681 | | 5/1996 | DiFreitas | 60/740 |
| 5,628,180 | | 5/1997 | DeFreitas | 60/39.06 |
| 5,631,815 | | 5/1997 | Cross | 363/68 |
| 5,695,328 | | 12/1997 | DeFreitas et al. | 431/268 |

* cited by examiner

*Primary Examiner*—Lesley D. Morris
(74) *Attorney, Agent, or Firm*—Lerner, David, Littenberg, Krumholz & Mentlik, LLP

(57) ABSTRACT

An electrostatic atomizer comprises a power source for powering a charge injection device, a controller for controlling the net charge injected by the charge injection device, and a sensor for sensing breakdown precursors in the vicinity of the orifice and producing a feedback signal upon the occurrence of the breakdown precursors. The sensor is in communication with the controller and the controller is responsive to the feedback signal so that upon occurrence of the feedback signal, the controller decreases the net charge injected. A method of minimizing corona-induced breakdown in an electrostatic atomizer comprises the steps of providing a fluent material with a net charge to atomize the fluent material, and responding to the occurrence of breakdown precursors by decreasing the net charge of the liquid to avoid corona-induced breakdown.

52 Claims, 9 Drawing Sheets

ELECTROSTATIC ATOMIZER WITH CONTROLLER

CROSS REFERENCE TO RELATED APPLICATIONS

This application claims benefit of U.S. Provisional Application Serial No. 60/106,421, filed Oct. 30, 1998, the disclosure of which is hereby incorporated by reference herein.

FIELD OF THE INVENTION

The present invention relates to electrostatic atomizers and to devices in which atomization of liquid is used, including fuel atomizers and combustion devices.

BACKGROUND OF THE INVENTION

Electrostatic atomizers disperse liquid by applying a net electrical charge to the liquid, typically as a stream of the liquid passes through an orifice. The negative charges developed within the liquid tend to repel one another, dispersing the liquid into droplets. The injection of the net charge into the liquid may be accomplished utilizing a pair of opposed electrodes arranged adjacent to the stream of liquid and electrically connected to a high voltage power source. Such an electrostatic atomizer, called the SPRAY TRIODE™ atomizer, is disclosed in certain embodiments of U.S. Pat. No. 4,255,777, the disclosure of which is hereby incorporated by reference herein. Another electrostatic atomizer utilizes an electron beam to apply a net negative charge to the liquid. Certain embodiments of U.S. Pat. Nos. 5,093,602 and 5,378,957, the disclosures of which are hereby incorporated by reference herein, disclose apparatus and methods for electrostatic atomization utilizing an electron beam.

Electrostatic atomization of Newtonian fluids adheres to the following equation: $D=75/\sqrt{\rho_e}$. D is the mean droplet size in microns and $\rho_e$ is the charge density of the fluid, in coulombs per meter cubed. Thus, the same size droplets will be produced whenever a particular charge density is achieved.

The greater the charge density injected into the liquid, the greater the droplet dispersion, the smaller the droplet size and the narrower the droplet distribution. A limit on the charge density which can be injected into the liquid is the phenomenon of corona-induced breakdown, which interrupts dispersion of the liquid. When a critical level of charge is reached, the spray plume collapses. FIG. 7A shows a spray plume during uninterrupted operation and FIG. 7B shows a spray plume during operation interrupted by corona-induced breakdown. For a combustion device, this means interruption of the flame operating on the electrostatically atomized fuel.

For example, a combustion device has been run on fuel atomized by the SPRAY TRIODE™ electrostatic atomizer. It was found that sustained operation close, i.e., within 50V, to the critical level for corona-induced breakdown, which was about 5 kV or more, was required for blue flame operation. However, when the net charge reached the critical level, operation of the combustion device was dramatically interrupted. Furthermore, the critical level of net charge at which corona-induced breakdown occurs depends upon the properties and flow rate of the fuel, which vary during operation of the combustion system. Changes in ambient pressure and temperature also affect the operation of the electrostatic atomizer.

It would be desirable to develop an electrostatic atomizer with improvements in sustained operation and the maximum charge density provided to a liquid.

SUMMARY OF THE INVENTION

The present invention addresses these needs.

An aspect of the present invention provides an electrostatic atomizer comprising a charge injection device for injecting a net charge into a fluent material to thereby atomize the fluent material, a power source for powering the charge injection device, a controller for controlling the net charge injected by the charge injection device, and a sensor for sensing breakdown precursors in the vicinity of the orifice. The sensor produces a feedback signal upon the occurrence of the breakdown precursors, the sensor being in communication with the controller. The controller is responsive to the feedback signal so that upon occurrence of the feedback signal, the controller decreases the net charge injected.

The controller varies the net charge injected into the stream of liquid to avoid corona-induced breakdown, which interrupts the atomization of the liquid. Corona-induced breakdown occurs at a particular level of net charge for the charge injection device. By controlling the level of net charge in response to the feedback signal, corona-induced breakdown is avoided, but the system operates on the highest level of net charge which can be used without corona-induced breakdown. During the onset of corona-induced breakdown, breakdown precursors develop in the vicinity of the orifice of the electrostatic atomizer. Accordingly, when breakdown precursors are sensed, the controller reduces the level of net charge injected into the stream of liquid by a predetermined amount.

In certain preferred embodiments, the controller is arranged to progressively increase the net charge until the feedback signal occurs, decrease the net charge injected by a predetermined amount in response to the feedback signal, and then progressively increase the net charge until the feedback signal recurs. The net charge may be decreased by a predetermined amount and then progressively increased after a predetermined dwell time has lapsed. Depending on the amount of decrease applied in response to the feedback signal, the rate of progressive increase, and conditions prevailing in the fluid flow, the controller may cause the amount of charge injected to rise and fall repeatedly so that during some brief intervals, the level of charge is above the level which can be applied without corona breakdown. As further explained below, charge levels above the long-term breakdown level can be applied for short intervals. In certain preferred embodiments, the system repeatedly brings the charge level up above the long-term breakdown level, which yields breakdown precursors and triggers the feedback signal, then decreases the charge level to or below the long-term breakdown level, responsive to the feedback signal, and then raises the charge level again. The overall result is a time-average charge level above the long-term breakdown level without breakdown.

In certain preferred embodiments, the controller is arranged to vary the net charge injected so that the net charge varies in accordance with a predetermined pattern of variation until the feedback signal occurs.

In certain preferred embodiments, the charge injection device includes a first surface and a second surface spaced apart from one another and disposed within the body. The power source provides a potential difference between the first and second surfaces so that a net charge may be injected into the stream of liquid. The first electrode may comprise a conically-shaped electrode having a pointed end, or any other shape. The second electrode comprises a surface having at least one aperture formed therein. The charge injection device, in other embodiments, includes an electron gun. Any charge injection device for injecting a fluent material with a net charge may be used.

In preferred embodiments, the electrostatic atomizer further comprises a body defining an orifice, the fluent material being a stream of liquid passing out of the orifice.

The sensor, in certain preferred embodiments, includes a loop antenna encircling the orifice. In other embodiments, the body is electrically connected to the sensor for sensing the breakdown precursors. In this embodiment, the atomizer includes a housing and the body is electrically isolated from the housing.

The net charge injected into the fluent material is related to the operating voltage applied to the charge injection device. In preferred embodiments, the controller is arranged to control an operating voltage applied to the charge injection device and to vary the operating voltage so that the operating voltage progressively increases until the feedback occurs, decreases in response to the feedback signal, and then progressively increases. The operating voltage is decreased by the controller by a predetermined amount and then progressively increased after a predetermined dwell time has elapsed.

In other preferred embodiments, the controller is arranged to control the operating voltage and to vary the operating voltage in accordance with a predetermined pattern of variation until the feedback signal occurs.

The controller is arranged to vary the net charge injected in a predetermined pattern so that a base level of net charge is applied, the net charge is increased by an incremental amount of net charge to a higher level, and then the net charge is decreased to the base level. The controller maintains the base level for a first predetermined time period and maintains the higher level for a second predetermined time period. The incremental amount of net charge may have a predetermined magnitude and the controller may reduce the incremental amount to a value less than the predetermined magnitude in response to receiving a feedback signal. The controller may reset the incremental amount of net charge to the predetermined magnitude until the feedback signal recurs.

In certain preferred embodiments, the base level has a predetermined magnitude and the controller reduces the amount for the base level in response to the feedback signal to an amount less than the predetermined magnitude.

The controller is preferably connected to the power source for controlling the power source so that the power source applies the varying operating voltage. The controller preferably includes a circuit for controlling the power source and also preferably includes a DC-DC converter. The circuit preferably detects breakdown precursors by detecting the voltages applied to the sensor by the breakdown precursors.

The electrostatic atomizer may include a source of a liquid, such as a source of fuel or some other liquid in communication with the body for providing a stream of liquid to be atomized. The liquid source may be arranged to vary the flow of the stream of liquid. This aspect of the present invention incorporates the realization that the amount of charge which can be injected without breakdown varies with the flow rate, and that control of the charge injection responsive to the feedback signal allows the amount of charge inserted to follow or "track" a varying fluid flow at all times. The amount of charge injected can be at or near the maximum allowable charge without breakdown.

In another aspect of the present invention, an apparatus for controlling the operation of an electrostatic atomizer so that the net charge applied to the liquid to be atomized is controlled includes a controller in communication with a sensor. The sensor produces a feedback signal upon receipt of a precursor signal, and the controller is responsive to the feedback signal so that upon occurrence of the feedback signal the controller decreases the net charge by a predetermined amount.

The controller, in certain preferred embodiments, is arranged to progressively increase the net charge until the feedback signal occurs, decrease the net charge injected by a predetermined amount, and then progressively increase the net charge after a predetermined dwell time has expired.

In another aspect of the present invention, a method of minimizing corona-induced breakdown in an electrostatic atomizer comprises providing a fluent material with a net charge to atomize the fluent material, and responding to the occurrence of breakdown precursors by decreasing the net charge of the fluent material to avoid corona-induced breakdown. The method preferably includes the step of sensing breakdown precursors before the step of responding. The method also preferably includes the step of producing a feedback signal upon sensing precursors and decreasing the net charge in response to the feedback signal.

In certain preferred embodiments, the method includes progressively increasing the net charge until the precursors occur, decreasing the net charge in response to the precursors, and then progressively increasing the net charge until precursors recur. The net charge is preferably decreased by a predetermined amount and then progressively increased after a predetermined dwell time has elapsed.

In other preferred embodiments, the method includes the step of varying the net charge provided the fluent material so that the net charge varies in accordance with a predetermined pattern of variation until precursors occur.

The method may include providing a potential difference between two spaced surfaces to provide the fluent material with net charge. The fluent material may also be provided net charge by an electron gun, or a pair of electrodes.

The method preferably comprises sensing precursors received by a loop antenna encircling the orifice of the atomizer. The fluent material may comprise a stream of liquid having a varying flow rate. The atomizer may include a variable orifice for controlling the flow of the stream of liquid.

The method preferably comprises applying an operating voltage to a charge injection device for providing the fluent material with net charge. In preferred embodiments, the method comprises controlling the operating voltage so that the operating voltage progressively increases until precursors occur, decreases in response to precursors and then progressively increases. The operating voltage is decreased by a predetermined amount and then progressively increased after a predetermined dwell time has elapsed. In certain preferred embodiments, the method includes controlling the operating voltage so that the operating voltage varies in accordance with a predetermined pattern of variation until the precursors occur.

In preferred embodiments, a base level of net charge is preferably applied, the net charge is increased by an incremental amount to a higher level, and then the net charge is decreased to the base level. The base level is preferably applied for a first predetermined time period, and then the higher level is preferably applied for a second predetermined time period. The incremental amount of net charge preferably has a predetermined magnitude. The step of decreasing the net charge in response to precursors may include reducing the incremental amount of net charge to a magnitude less than the predetermined magnitude in response to precursors. The incremental amount will be reset to the predetermined magnitude until precursors recur.

The base level may have a predetermined magnitude and the step of reducing the net charge in response to precursors may include reducing the base level to an amount less than the predetermined magnitude. The base level may be reset at the predetermined magnitude until precursors recur.

BRIEF DESCRIPTION OF THE DRAWINGS

These and other features, aspects and advantages of the present invention will become better understood with regard to the following description, appended claims, and accompanying drawings where:

DETAILED DESCRIPTION OF THE INVENTION

Figure 1:
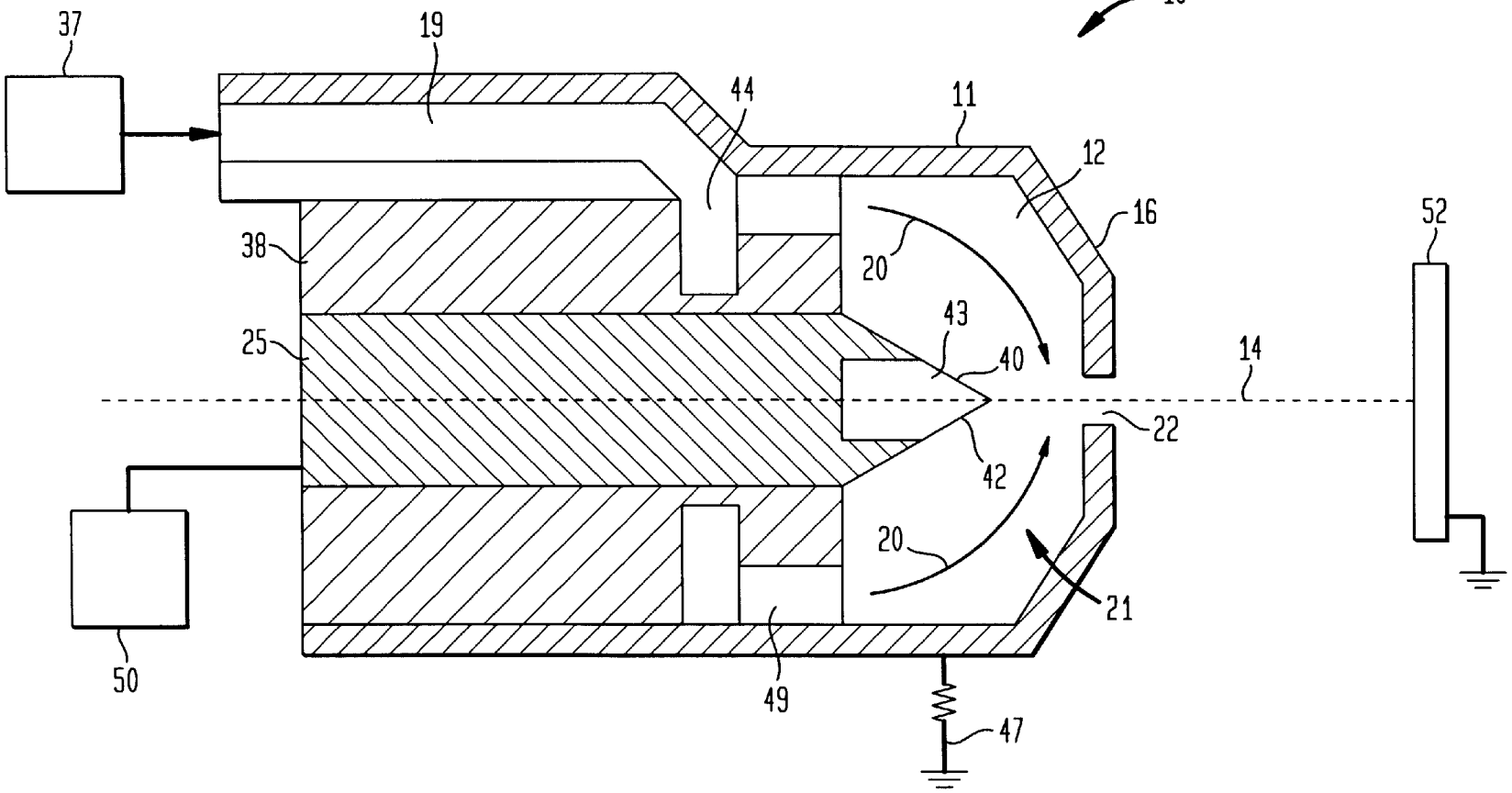
FIG. 1 is a schematic cross-sectional view of an atomizer in accordance with a first embodiment of the invention.

An electrostatic atomizer in accordance with one embodiment of the present invention is illustrated by FIG. 1. The electrostatic atomizer 10 according to this embodiment includes a SPRAY TRIODE™ atomizer, in accordance with certain embodiments of U.S. Pat. No. 4,255,777, the disclosure of which is hereby incorporated by reference herein.

A generally cylindrical electrically conductive metallic body 11 with a central axis 14 has a liquid supply line 19 formed therein and opens into a central chamber 12. Body 11 defines a forward wall 16 having an orifice 22 opening therethrough on central axis 14. An electrically insulating support 38 is disposed within the central chamber 12 of body 11. Insulator 38 is generally cylindrical and coaxial with body 11. The insulator defines a plurality of liquid distribution channels 44 extending generally radially and a set of axially extensive grooves 49 adjacent the outer periphery of the insulator. Radial channels 44 merge with one another adjacent the central axis 14 of the insulator and body 11 and merge with the grooves 49. Further, the radial channels 44 and axial grooves 49 communicate with the inlet passage 19 of body 11, so that the inlet passage is in communication, via the radial channels 44, with all the axial grooves 49 around the periphery of insulator 38. A liquid source 37 delivers liquid to conduit 19 so that the liquid flows through channels 44 and grooves 49 to the chamber 12. Insulator 38 may be formed of any substantially rigid dielectric material, such as a glass, non-glass ceramic, thermoplastic polymer or thermosetting polymer.

A charge injection device 21 comprises a central electrode 25. A central electrode 25 is mounted within insulator 38 and electrically insulated from the body 11 by insulator 38. Central electrode 25 has a pointed forward end 42 disposed in alignment with orifice 22 and in close proximity thereto. The forward tip 40 of central electrode 25 is formed from a fibrous material having electrically conductive fibers 43 extending generally in the axial direction of the electrode and of body 11, each such fiber 43 having a microscopic point, these points cooperatively constituting the surface of tip 40. A ground electrode 52 is mounted remote from body 11 and remote from orifice 22. Although electrode 52 is schematically illustrated as a flat plate in FIG. 1, its geometrical form is not critical. Where the atomized liquid is directed into a vessel, pipe or other enclosure, the ground electrode may be a wall of the enclosure.

Ground electrode 52 is at a reference or ground electrical potential. The body 11 is connected via a resistor to the ground potential 47. Tip 40 of central electrode 25 is connected to a high voltage potential source 50. The foregoing components of the apparatus may be generally similar to the corresponding components of the apparatus called the SPRAY TRIODE™ atomizer, disclosed in certain embodiments of U.S. Pat. No. 4,255,777, the disclosure of which is hereby incorporated by reference herein.

Figure 2:
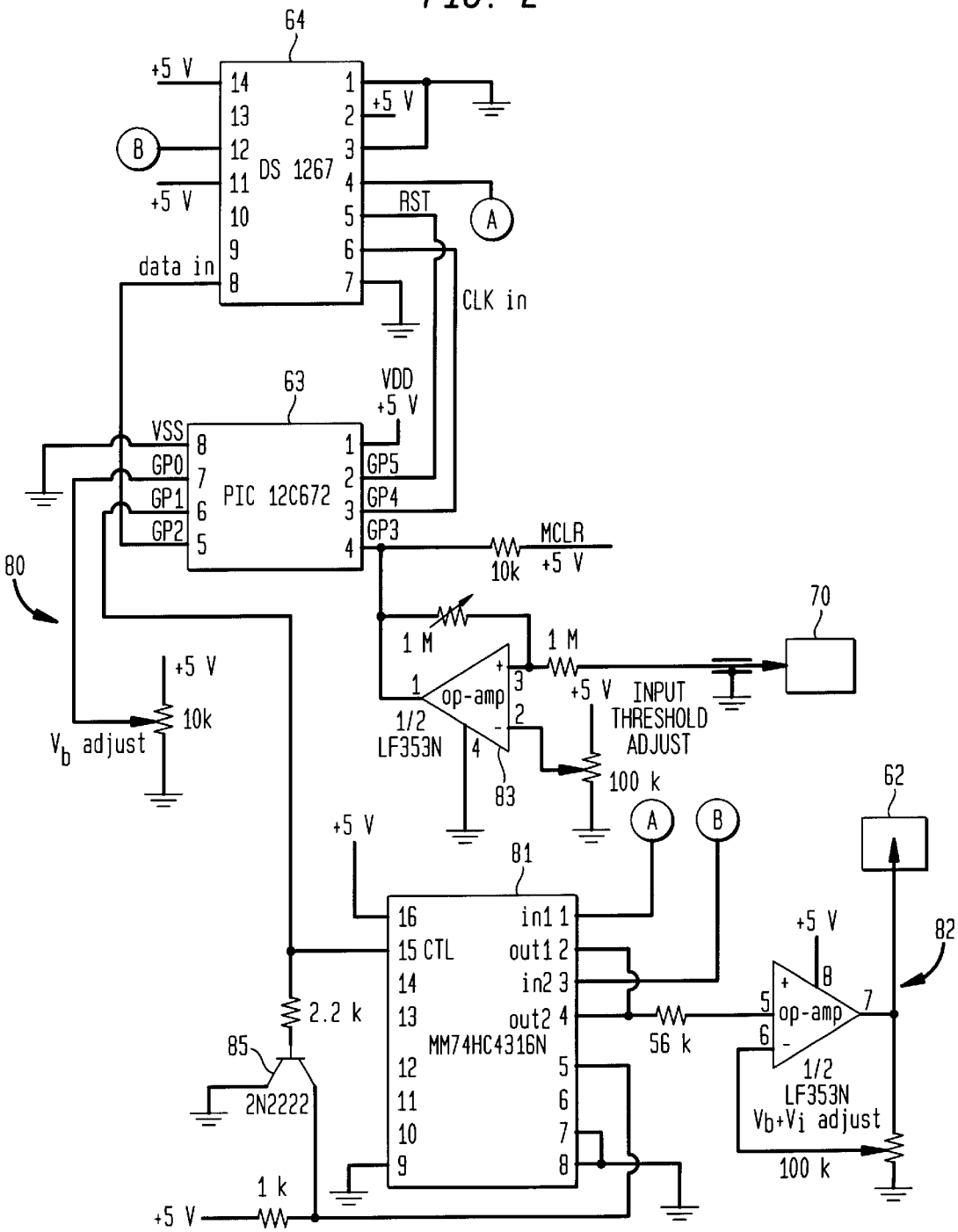
FIG. 2 is a schematic circuit diagram of a controller for the atomizer of FIG. 1.
Figure 4:
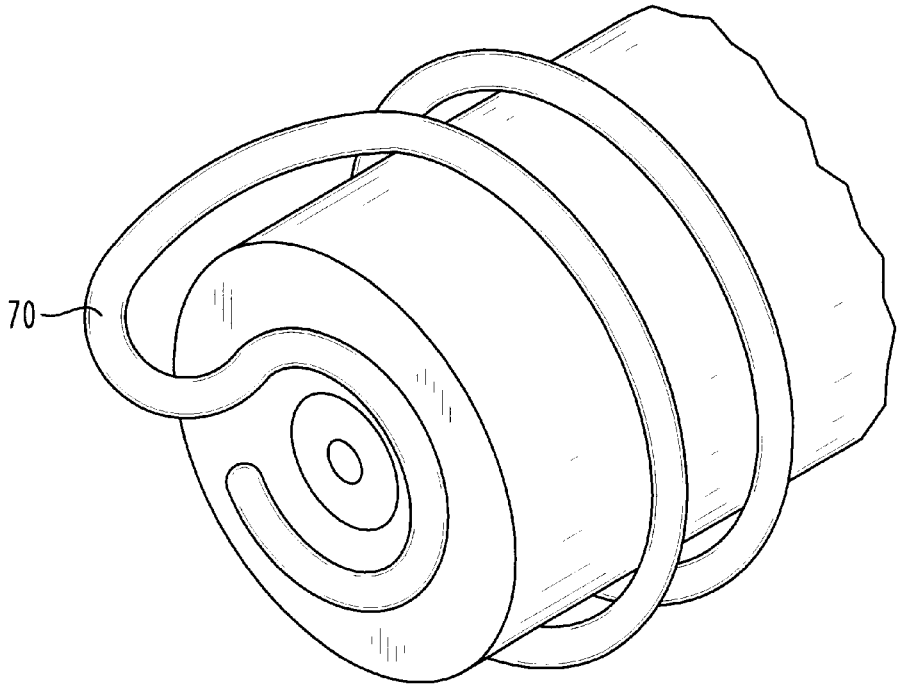
FIG. 4 is a photograph of an electrostatic atomizer with a loop antenna sensor for the electrostatic atomizer of FIGS. 1–3.

The high-voltage power source 50 comprises a controller circuit 80 and a DC-DC converter 62. As shown in FIG. 2, the controller circuit 80 in this embodiment includes a central processing unit ("CPU") 63 connected to a dual digital resistor 64. The digital resistor 64 is connected to a an analog switch 81, which is in turn connected to an amplifier 82. The amplifier 82 is connected to a DC-DC converter. A transistor 85 is connected to the switch 81 and the CPU 63. A sensor comprising a loop antenna 70 in this embodiment, is connected to another amplifier 83, as shown in FIG. 2. Amplifiers 82 and 83 may be included in one component. The antenna may be comprised of a 5 millimeter diameter insulated wire in the shape of an open loop curving around the orifice 22 of the electrostatic atomizer. FIG. 4 shows the antenna mounted on the electrostatic atomizer.

The components utilized in the controller 80 are: microchip PIC 12C672, manufactured by Microchip Technology, Inc., Tempe, Ariz., as the CPU 63; Dallas Semiconductor Model DS1267, as the digital resistor 64, manufactured by Dallas Semiconductor, Dallas, Tex., the model MM74HC4316M, manufactured by Fairchild Semiconductor, Corp., South Portland, Me. as the switch 81; 2N2222 power transistor as the transistor 85; and model LF353N, manufactured by National Semiconductor, Santa Clara, Calif., as the amplifier 82. The DC-DC converter is a Model No. DX150N by EMCO High Voltage, Inc., 11126 Ridge Road, Sutter Creek, Calif. 95685 (the EMCO converter). Many variations of the components discussed above would produce suitable results as a controller circuit in accordance with the invention. For example, other components for adjusting the digital output of the chip 63 and producing a voltage suitable as the input for the particular DC-DC converter may be used. In addition, the controller 80 may also be used with hard-wired components. Indeed, any electrical arrangement which allows variation of the charge injection in response to a signal produced by a sensor can be used.

The CPU 63 provides a signal which is used to vary the output for the high voltage power source 50, according to a predetermined waveform which is modified to avoid corona-induced breakdown.

During the onset of corona-induced breakdown, precursor signals develop in the vicinity of the orifice 22 of the electrostatic atomizer 10. The precursor signals are well defined and easily detected. The precursor signals on antenna 70 typically take less than 0.1 microseconds to develop and have amplitudes of 0.5 volts or more. The antenna 70 attached to the high voltage power source 50 detects precursor signals so that the controller 80 may respond accordingly to avoid corona-induced breakdown.

Corona-induced breakdown occurs as the stream of liquid 20 exits the orifice 22 of the electrostatic atomizer 10. Accordingly, loop antenna 70, is preferably placed in the region of the orifice 22 at the exterior 13 of the electrostatic atomizer.

Figure 8A:
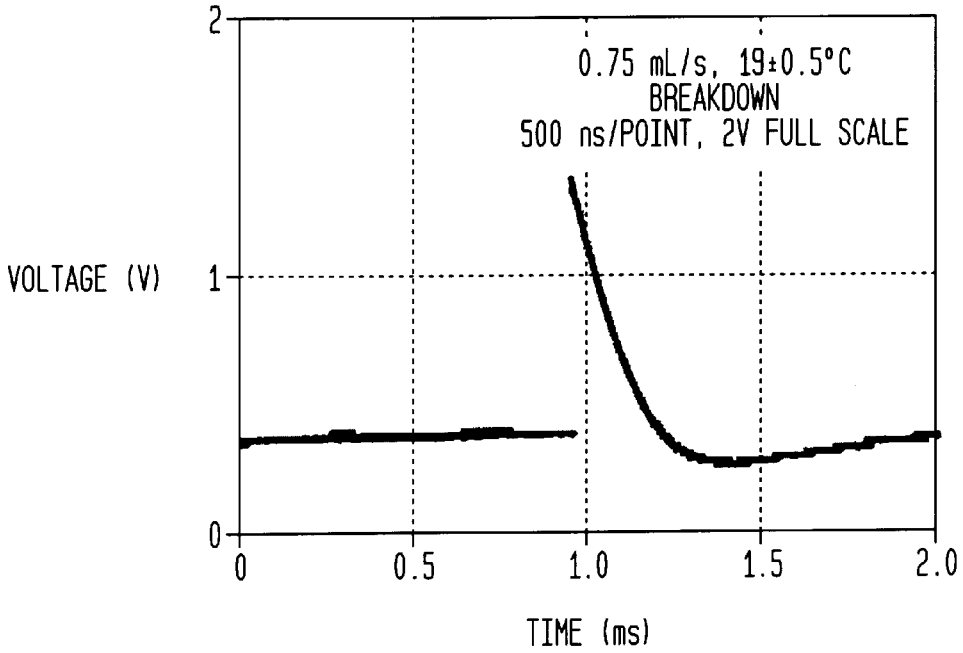
FIG. 8A is a graph illustrating an isolated precursor signal.
Figure 8B:
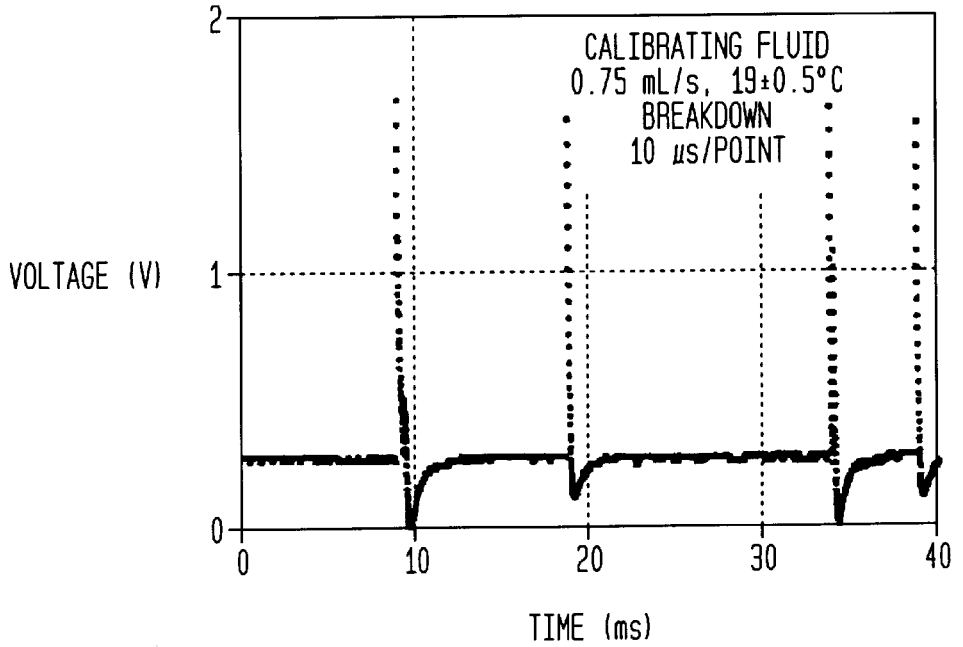
FIG. 8B is a graph illustrating multiple precursor signals.
Figure 8C:
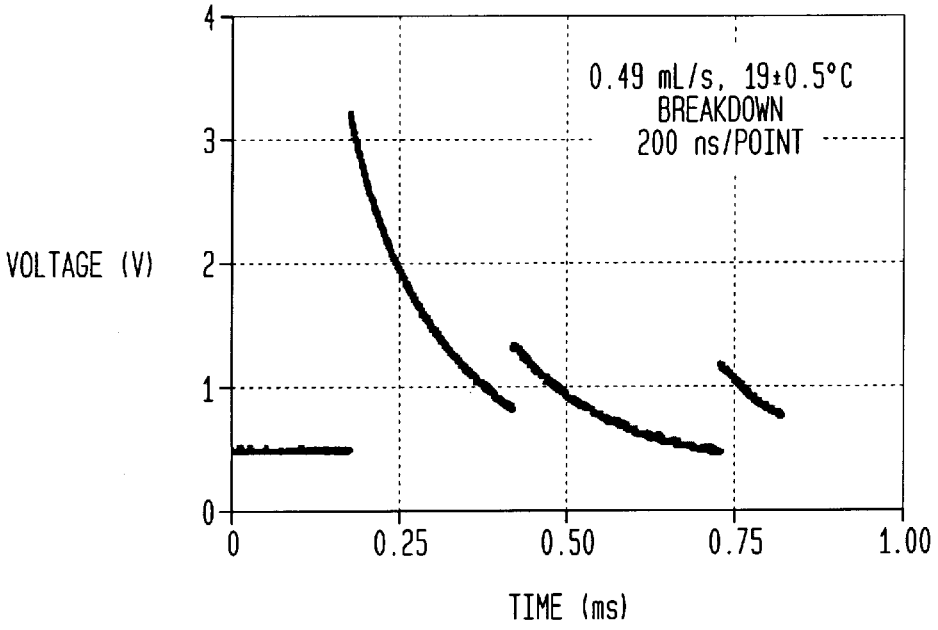
FIG. 8C is a graph illustrating another set of multiple precursor signals.
Figure 8D:
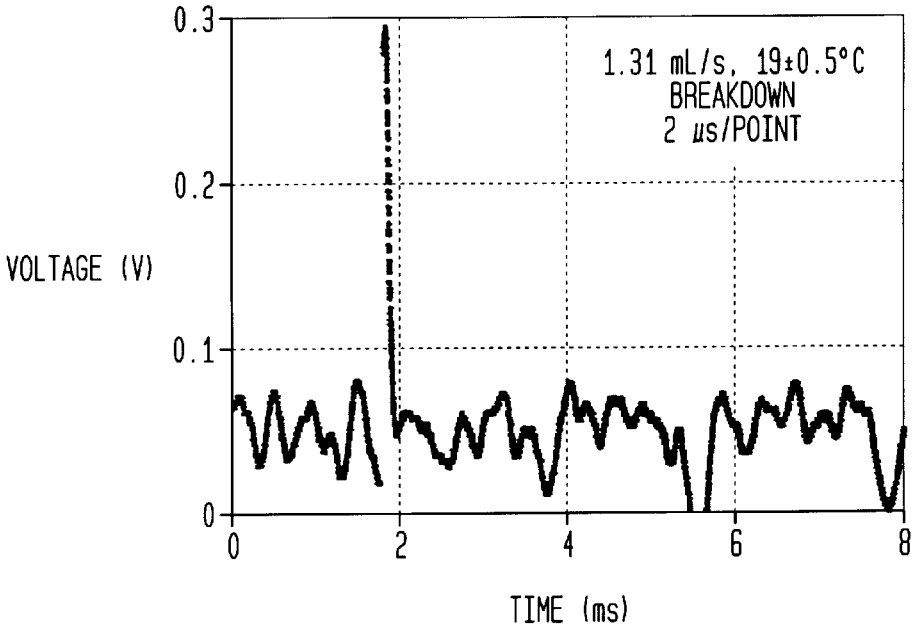
FIG. 8D is a graph illustrating yet another set of multiple precursor signals.

The output of the antenna 70 was measured during operation of the SPRAY TRIODET™ atomizer. The SPRAY TRIODE™ atomizer was operated utilizing a 0.75 milliliter per second stream of jet-A fuel. A single precursor signal, comprising a pulse having an amplitude of about 1 volt may develop, as shown in FIG. 8A, or, as shown in FIG. 8B, a series of precursor signals may develop during operation of the electrostatic atomizer. At a lower flow rate of 0.49 milliliters per second, some variability in the amplitude of the precursor signals is experienced, as shown in FIG. 8C. The signals remained sharply delineated. However, as shown in FIG. 8D, the nature of the signals changes for a higher flow rate of 1.31 milliliters per second. Accordingly, it is preferred that the design of the antenna accommodate the flow range for the particular device which will incorporate the electrostatic atomizer. The loop antenna utilized in this embodiment can detect precursor signals of about 50 or more milivolts.

Figure 3:
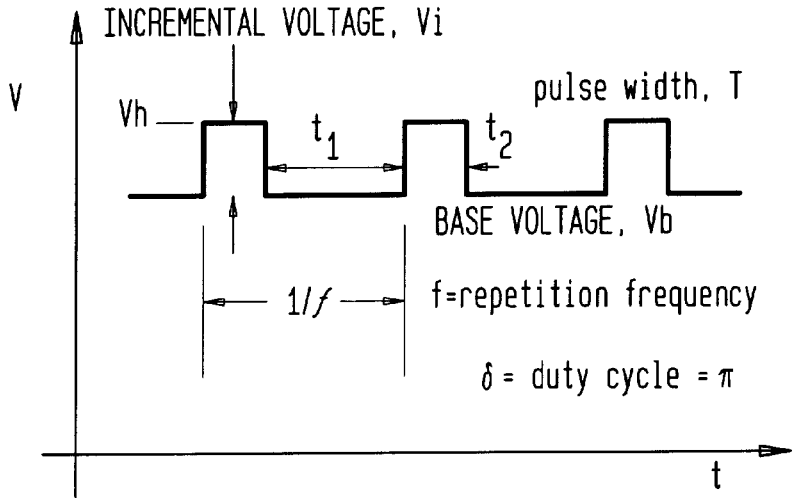
FIG. 3 is a graph illustrating a predetermined pattern of variation for a controller of the atomizer of FIGS. 1–2.

The CPU generates a digital output which varies according to a basic waveform, which the controller 80 translates into an operating voltage applied to the charge injection device 21. The basic waveform is depicted in FIG. 3. The parameters for the basic waveform shown in FIG. 3 are: the base voltage (Vb), the incremental voltage (Vi), the repetition frequency (f), and the duty cycle (d). The base voltage Vb has an initial preset value for an operating voltage lower than the critical voltage at which corona-induced breakdown will occur. The incremental voltage Vi is the amount of additional voltage applied over the base voltage to apply a higher voltage (Vh) greater than the base voltage and above the level of voltage at which corona-induced breakdown occurs. The duty cycle d is the width of a pulse (T) per unit time. These parameters are illustrated on the basic waveform in FIG. 3. The preset values for the base voltage and incremental voltage are determined experimentally for a particular electrostatic atomizer.

The CPU 63 varies the values of the base voltage (Vb) and the incremental voltage (Vi) in response to precursor signals received by the antenna 70. In operation, the CPU generates a digital output which varies according to the basic waveform. The CPU output causes the resistance of the digital resistor 64, which is configured to operate in a digital to analog mode, to vary. The resistor 64 delivers a signal to the analog switch 81 which switches between either of the two voltage settings Vb and Vi. The output from the analog switch is amplified by the amplifier 82. The amplifier thus provides a varying signal to the DC-DC converter to drive the DC-DC converter 62. The power transistor 85 converts the low energy output from the controller to power the converter. This causes the output of the high voltage power source 50 to vary.

Upon receipt of a precursor signal by the antenna 70, which is preferably greater than a prescribed, adjustable threshold level, a feedback signal is delivered to the CPU 63. Upon receipt of the feedback signal, the CPU 63 requires a reduction in the incremental voltage Vi. Thus, the operating voltage applied to the charge injection device 21 follows the basic waveform, with the magnitude of the incremental voltage Vi reduced so that the magnitude of the higher voltage Vh is also reduced. The controller 80 then adjusts the value for the incremental voltage Vi to its predetermined, preset value.

Accordingly, the operating voltage applied to the charge injection device 21 varies so that the operating voltage increases from the base voltage Vb by an incremental voltage Vi to a higher voltage Vh. The higher voltage is maintained for a period of time t2, and the operating voltage is then decreased to the base voltage, which is maintained for a period of time t1. This pattern is repeated until a feedback signal is received from the sensor 70. In response to the feedback signal, the controller 80 modifies the value of Vi to decrease the same so that corona-induced breakdown is avoided. The CPU 63 is programmed to control the high-voltage power source 50, utilizing the above parameters and in response to the feedback signal produced by the sensor 80, so that the operating voltage is reduced in response to a precursor signal before corona-induced breakdown fully develops. In other embodiments, the controller may be arranged to modify the preset value for the base voltage Vb.

Figure 5:
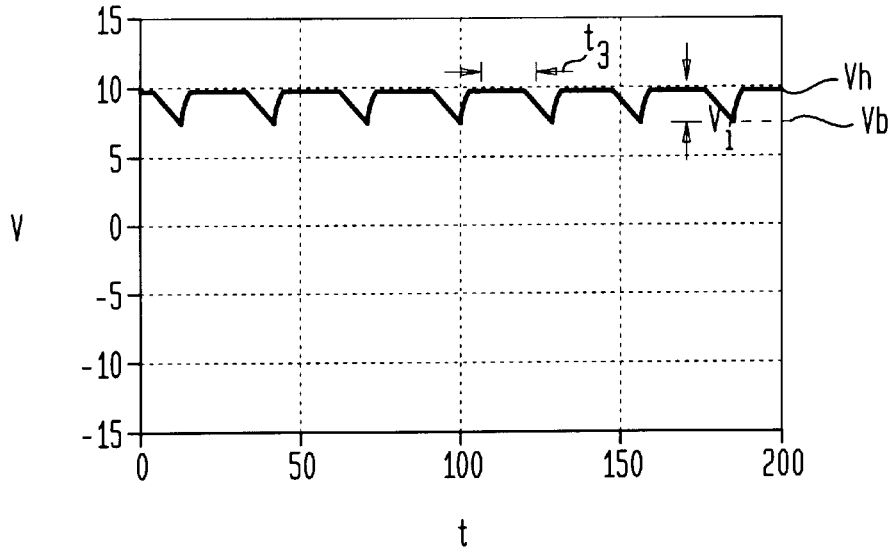
FIG. 5 is a graph illustrating the operating voltage for a power source in an electrostatic atomizer of FIGS. 1–4.
Figure 6:
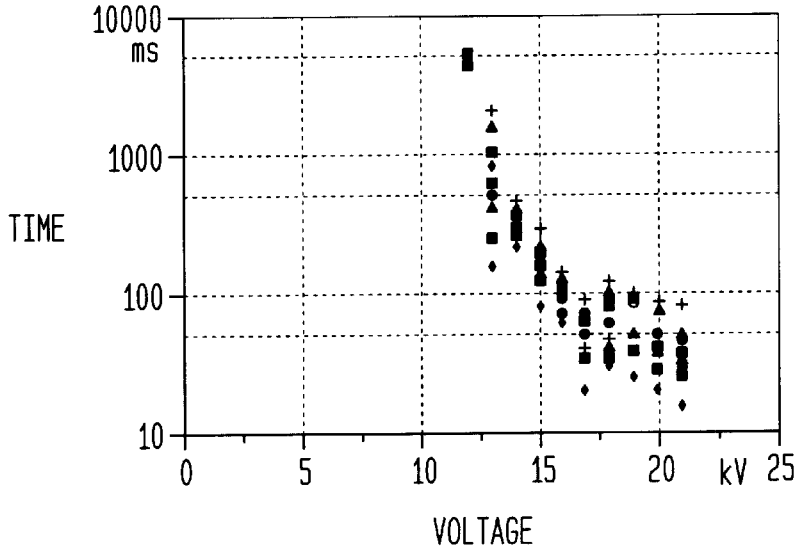
FIG. 6 is a graph illustrating the dependence of the breakdown phenomenon on time.
Figure 7A:
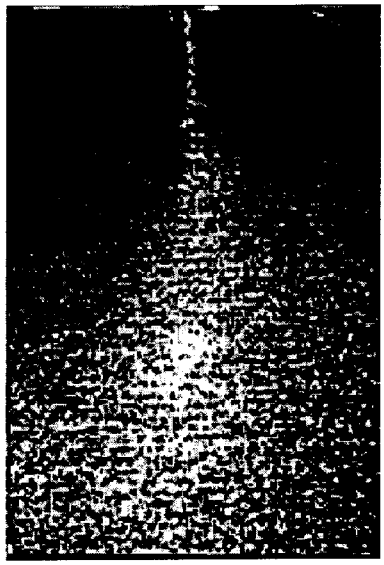
FIG. 7A is a photograph of a spray plume for an atomized liquid uninterrupted by corona-induced breakdown.
Figure 7B:
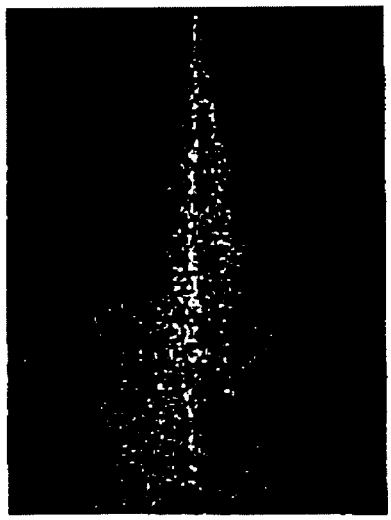
FIG. 7B is a photograph of a spray plume for an atomized liquid interrupted by corona-induced breakdown.
Figure 9:
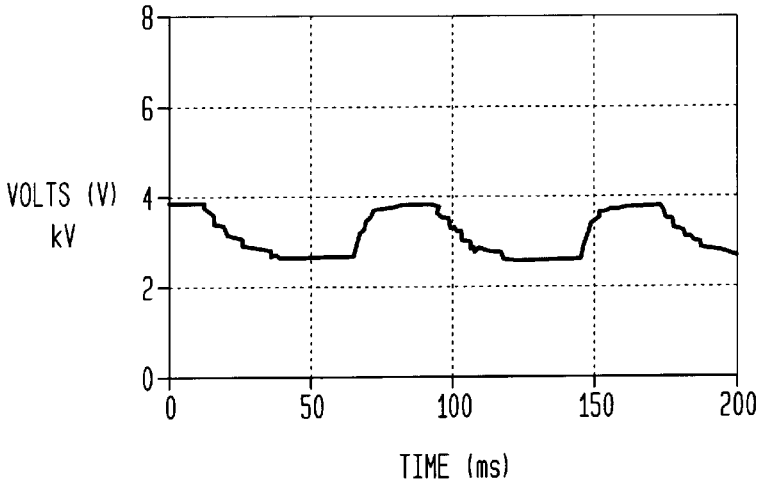
FIG. 9 is a graph illustrating the operating voltage for a power source in an electrostatic atomizer in accordance with another embodiment of the invention.

The DC-DC converter is most preferably as agile as possible, having a high-voltage output replicating the low voltage input as accurately as possible. However, a rapid response DC-DC converter capable of varying the operating voltage before the onset of corona-induced breakdown can be used. The most preferred DC-DC converter is manufactured by Electric Research & Development Laboratory in Waterloo, Ontario, Canada, and incorporates circuitry disclosed in U.S. Pat. No. 5,631,815, the disclosure of which is hereby incorporated by reference herein (the ERDL converter). This converter produces the output shown in FIG. 9, which would be modified by the controller 80 in a similar fashion. The EMCO converter discussed above in connection with FIGS. 1–4 generates the output shown in FIG. 5.

Figure 10:
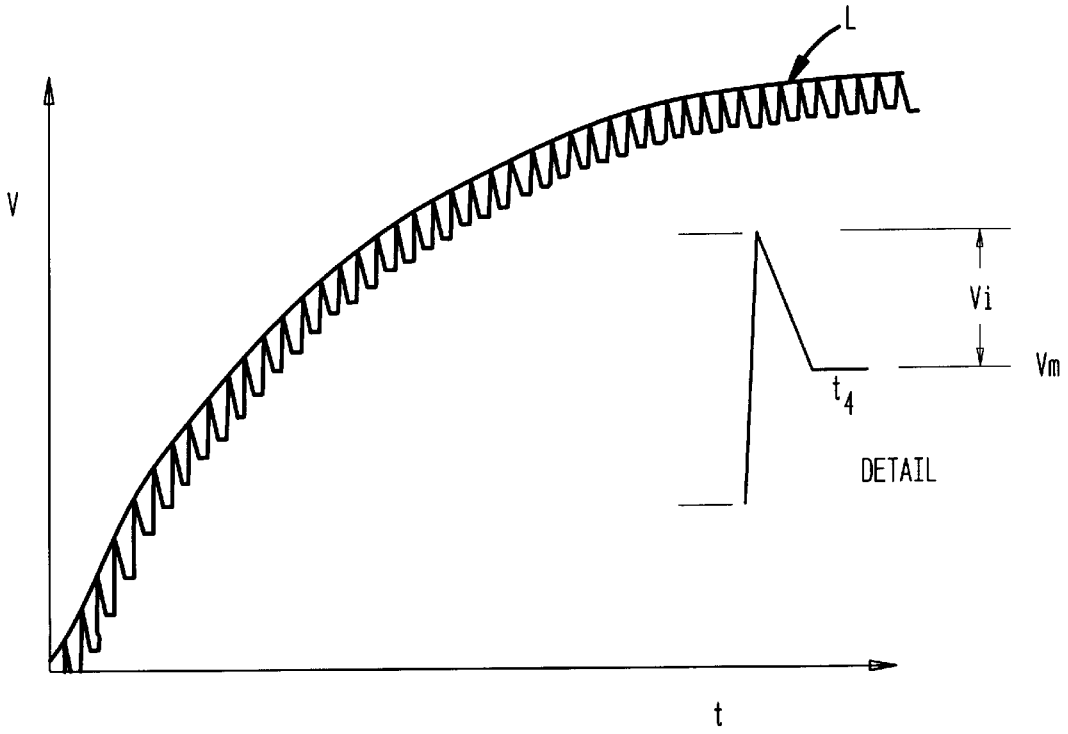
FIG. 10 is a graph illustrating the operating voltage for a power source controlled by a controller in an electrostatic atomizer in accordance with a further embodiment of the invention.
Figure 11:
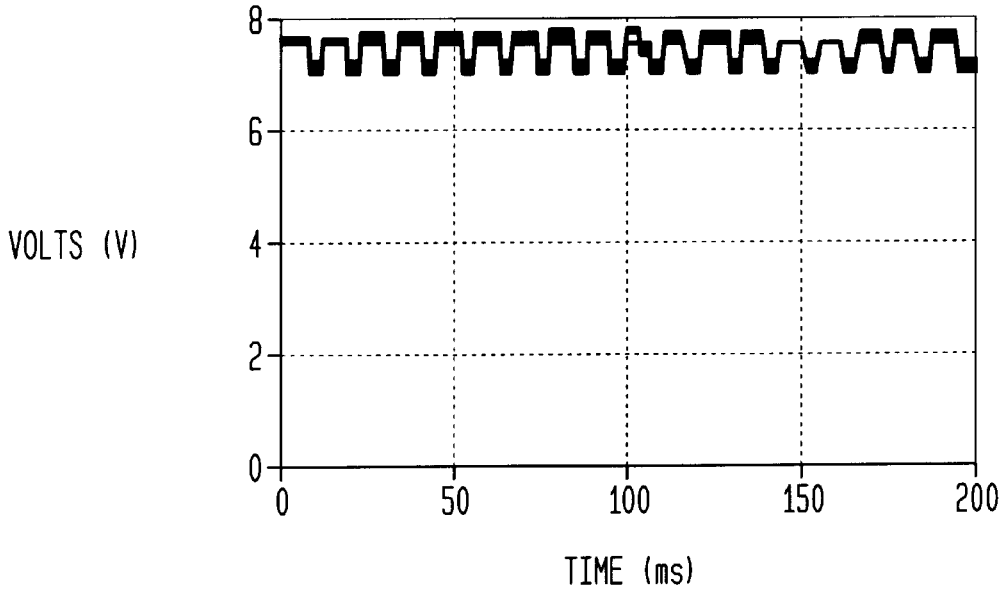
FIG. 11 is a graph illustrating the operating voltage for a power source controlled by a controller in the electrostatic atomizer of FIGS. 1–5.

In a preferred embodiment of the invention, the controller 80 is programmed to progressively increase the operating voltage until a feedback signal from the antenna 70 is received by the controller. After receipt of such signal, the controller 80 requires a decrease in the operating voltage by a predetermined incremental voltage Vi to a modified level of voltage Vm. The modified level of voltage is applied for a predetermined dwell time, t4. After the dwell time t4 has elapsed, the controller 80 requires the operating voltage to increase until the receipt of another feedback signal from the sensor, when the antenna 70 receives a precursor signal. This pattern is shown in FIG. 10. As seen in FIG. 10, the limit L at which the precursor signal occurs, causing the controller 80 to reduce the operating voltage, increases during the operation of the electrostatic atomizer. Accordingly, the operating voltage applied to the charge injection device 21 is greater, and the net charge injected into the stream of fluid 20 is therefore also greater than would be achieved by operating the charge injection device 21 on a constant voltage. As the flow rate changes, the atomizer takes into account the changing flow rate and obtains maximum net charge by increasing the charge until precursors occur.

In another embodiment of the invention, the sensor includes an electrically isolated atomizer casing for detecting precursor signals in the vicinity of the orifice 22. In other embodiments, the sensor comprises an electrode or some other probe in the vicinity of the orifice.

In other embodiments of the invention, the electrostatic atomizer includes a charge injection device comprising an electron gun, as disclosed in U.S. Pat. Nos. 5,478,266; 5,391,958; 5,378,957; and 5,093,602, hereby incorporated by reference herein. The net charge would be varied by supplying the electron gun with a varying voltage as discussed above, or by varying the operating voltage so that the electron beam is turned on and off. Alternatively or additionally, the electron gun can include elements such as a grid to modulate the electron beam within the gun, and the grid voltage can be adjusted. For a further arrangement, two independently operable electron beams can be provided in a single gun or in dual guns, and one beam can be turned on and off repeatedly to vary the net charge injected into the liquid. In a further arrangement, an electron gun can be combined with an electrode-type (for example, a SPRAY TRIODE™ atomizer) charge injection apparatus, so that the net charge in the liquid is contributed to by both the beam and the electrodes. One source can be turned on and off, or modulated in other ways to vary the net charge injected into the liquid.

In preferred embodiments, the electrostatic atomizer includes a dielectric structure disposed between the chamber and a second electrode adjacent the orifice, as discussed in U.S. Provisional Patent Application No. 60/114,727, filed Dec. 31, 1998, the disclosure of which is hereby incorporated by reference herein. The dielectric structure insulates the second electrode from the interior space of the chamber. This arrangement reduces or eliminates buildup of residue in and around the orifice.

Preferred embodiments include the electrostatic atomizer disclosed in certain embodiments of U.S. patent Ser. No. 09/237,583, filed Jan. 26, 1999 by Arnold J. Kelly, the disclosure of which is hereby incorporated by reference herein. In certain embodiments, the flow of liquid through the orifice of the atomizer is varied through a variable orifice, comprising a sleeve having a V-shaped notch which is moveable across another element having an aperture. The intersection of the V-shaped notch and aperture form the orifice for the atomizer.

The phenomenon of corona-induced breakdown interrupts atomization and charge injection in many contexts. Thus, aspects of the present application may be applied to the atomization and charge injection of any fluent material. In addition, electrostatic atomizers in accordance with aspects of the present invention may atomize or inject charge into a number of liquid materials, such as fuel, liquid polymers, aerosols, water, or any other liquid.

As will be readily appreciated, numerous other variations and combinations of the features discussed above will be employed without departing from the present invention. Accordingly, the foregoing description of certain preferred embodiments should be taken by way of illustration, rather than by way of limitation, of the features discussed above.

EXPERIMENTAL EXAMPLE OF A PREFERRED EMBODIMENT

A SPRAY TRIODE™ electrostatic atomizer, in accordance with certain embodiments of U.S. Pat. No. 4,255,777, the disclosure of which is hereby incorporated by reference herein, was utilized in conjunction with a controller illustrated in FIG. 2, operating on jet-A fuel. The CPU 63 was programmed to generate a 90 hertz waveform having a 0.7 duty cycle. FIG. 10 shows how the operating voltage for the high-voltage power source varies over time. During the first 100 milliseconds, the atomizer operated at a voltage level close to its maximum operating voltage. At 104 milliseconds, a precursor signal was detected. The incremental voltage was decreased in response to the same. A second set of precursor signals was detected soon after, so that the controller modified the incremental voltage to a value equal to the base voltage. For about another 27 milliseconds, the electrostatic atomizer operated without the occurrence of a precursor signal. The electrostatic atomizer resumed operation at the basic waveform. After 27 milliseconds, a third precursor signal was received. The controller responded by reducing the incremental voltage. After about 30 milliseconds, operation at the basic waveform and close to the maximum voltage resumed. The spray plume maintained vigorous operation and no noticeable interruption of the spray plume was observed.

What is claimed is:

1. An electrostatic atomizer, comprising:

a) a charge injection device for injecting a net charge into a fluent material to thereby atomize the fluent material;

b) a power source for powering said charge injection device;

c) a controller for controlling the net charge injected by said charge injection device; and d) a sensor for sensing breakdown precursors in the vicinity of said orifice and producing a feedback signal upon the occurrence of said breakdown precursors, said sensor being in communication with said controller and said controller being responsive to said feedback signal so that upon occurrence of said feedback signal, said controller decreases the net charge injected.

2. The electrostatic atomizer of claim 1, wherein said controller is arranged to progressively increase the net charge until said feedback signal occurs, decrease the net charge injected by a predetermined amount in response to the feedback signal, and then progressively increase the net charge until the feedback signal returns.

3. The electrostatic atomizer of claim 2, wherein the net charge is decreased by said predetermined amount and then progressively increased after a predetermined dwell time has elapsed.

4. The electrostatic atomizer of claim 1, wherein said controller is arranged to vary the net charge injected so that the net charge varies in accordance with a predetermined pattern of variation until said feedback signal occurs.

5. The electrostatic atomizer of claim 1, wherein said charge injection device includes a first surface and a second surface spaced apart from one another and said power source provides a potential difference between said first and second surfaces.

6. The electrostatic atomizer of claim 5, wherein said first surface comprises a conically-shaped electrode having a pointed end.

7. The electrostatic atomizer of claim 6, wherein said second surface comprises a surface having at least one aperture formed therein.

8. The electrostatic atomizer of claim 1, wherein said charge injection device includes an electron gun.

9. The electrostatic atomizer of claim 1 further comprising a body defining an orifice, and the fluent material comprises a stream of liquid, the stream of liquid being atomized as said stream of liquid passes out of said orifice.

10. The electrostatic atomizer of claim 9, wherein said sensor includes a loop antenna encircling said orifice.

11. The electrostatic atomizer of claim 9, wherein said body is electrically connected to said sensor for sensing said breakdown precursors.

12. The electrostatic atomizer of claim 11, wherein said atomizer includes a housing and said body is electrically isolated from said housing.

13. The electrostatic atomizer of claim 1, wherein said controller is arranged to control an operating voltage applied to said charge injection device and to vary said operating voltage so that said operating voltage progressively increases until said feedback signal occurs, decreases in response to said feedback signal, and then progressively increases.

14. The electrostatic atomizer of claim 13, wherein said operating voltage is decreased by said controller by a predetermined amount and then progressively increased after a predetermined dwell time has elapsed.

15. The electrostatic atomizer of claim 1, wherein said controller is arranged to control an operating voltage applied to said charge injection device and to vary said operating voltage in accordance with a predetermined pattern of variation until said feedback signal occurs.

16. The electrostatic atomizer of claim 4, wherein said controller is arranged to vary the net charge injected in a predetermined pattern so that a base level of net charge is applied, the net charge is increased by an incremental amount to a higher level of charge, and then the net charge is decreased to said base level.

17. The electrostatic atomizer of claim 16, wherein said controller maintains said base level for a first predetermined time period, and maintains said higher level for a second predetermined time period.

18. The electrostatic atomizer of claim 16, wherein said incremental amount of net charge has a predetermined magnitude in the absence of said feedback signal and said controller reduces said incremental amount to a magnitude less than the predetermined magnitude in response to receiving said feedback signal.

19. The electrostatic atomizer of claim 18, wherein said controller resets said incremental amount of net charge to said predetermined magnitude until said feedback signal recurs.

20. The electrostatic atomizer of claim 16, wherein said base level has a predetermined magnitude and said controller reduces the magnitude of said base level in response to said feedback signal to an amount less than said predetermined magnitude.

21. The electrostatic atomizer of claim 13, wherein said controller is connected to said power source for controlling said power source so that said power source applies said varying operating voltage.

22. The electrostatic atomizer of claim 15, wherein said controller is connected to said power source for controlling said power source so that said power source applies said varying operating voltage.

23. The electrostatic atomizer of claim 1, wherein said controller includes a circuit for controlling said power source.

24. The electrostatic atomizer of claim 1, wherein said power source includes a DC-DC converter.

25. The electrostatic atomizer of claim 1, wherein said controller includes a circuit for detecting breakdown precursors by detecting voltages applied to said sensor by said breakdown precursors.

26. The electrostatic atomizer of claim 1, further comprising a liquid source in communication with said body for providing a stream of liquid to be atomized.

27. The electrostatic atomizer of claim 24, wherein said liquid source is arranged to vary the flow of said stream of liquid.

28. An apparatus for controlling the operation of an electrostatic atomizer so that the net charge applied to the fluent material to be atomized is controlled, including a controller in communication with a sensor for producing a feedback signal upon receipt of a precursor signal, said controller being responsive to said feedback signal so that upon occurrence of said feedback signal, said controller decreases the net charge by a predetermined amount.

29. The apparatus of claim 28, wherein said controller is arranged to progressively increase the net charge until said feedback signal occurs, decrease the net charge injected by a predetermined amount, and progressively increase the net charge after a predetermined dwell time has expired.

30. A method of minimizing corona-induced breakdown in an electrostatic atomizer comprising the steps of:

providing a fluent material with a net charge to atomize the fluent material; and responding to the occurrence of breakdown precursors by decreasing the net charge of the liquid to avoid corona-induced breakdown.

31. The method of claim 30, further comprising the step of sensing breakdown precursors before the step of responding.

32. The method of claim 31, further comprising the steps of producing a feedback signal upon sensing precursors and decreasing the net charge in response to said feedback signal.

33. The method of claim 30, further comprising progressively increasing the net charge until the precursor occurs, decreasing said net charge in response to the precursors, and then progressively increasing the net charge until precursors recur.

34. The method of claim 33, wherein the net charge is increased by a predetermined amount and then progressively increased after a predetermined dwell time has elapsed.

35. The method of claim 30, further comprising the step of varying the net charge provided the fluent material so that the net charge varies in accordance with a predetermined pattern of variation until precursors occur.

36. The method of claim 30, further comprising the step of providing a potential difference between two spaced surfaces to provide the fluent material with net charge.

37. The method of claim 30 wherein the fluent material is provided net charge by an electron gun.

38. The method of claim 30 wherein the fluent material is provided net charge by a pair of electrodes.

39. The method of claim 30 further comprising sensing precursors received by a loop antenna encircling the orifice of the atomizer.

40. The method of claim 30 wherein the fluent material comprises a stream of liquid having a varying flow rate.

41. The method of claim 40 wherein the fluent material comprises a stream of liquid and the atomizer includes a variable orifice for controlling the flow of the stream of liquid.

42. The method of claim 30, wherein said step of providing a fluent material with a net charge includes applying an operating voltage to a charge injection device for providing the stream of liquid with net charge.

43. The method of claim 42, wherein said step of responding to the occurrence of breakdown precursors includes controlling the operating voltage so that the operating voltage progressively increases until the precursors occur, decreases in response to precursors, and then progressively increases.

44. The method of claim 43, wherein the operating voltage is decreased a predetermined amount and then progressively increased after a predetermined dwell time has elapsed.

45. The method of claim 42, further comprising controlling the operating voltage so that the operating voltage varies in accordance with a predetermined pattern of variation until the precursors occur.

46. The method of claim 35, wherein a base level of net charge is applied, the net charge is increased by an incremental amount of net charge to a higher level, and then the net charge is decreased to the base level.

47. The method of claim 46, wherein the base level is applied for a first predetermined time period, and the higher level is applied for a second predetermined time period.

48. The method of claim 46, wherein the incremental amount of net charge has a predetermined magnitude.

49. The method of claim 48, wherein the step of decreasing the net charge in response to precursors includes reducing the incremental amount of net charge to a magnitude less than the predetermined magnitude in response to precursors.

50. The method of claim 49, further comprising resetting the incremental amount to the predetermined magnitude until precursors recur.

51. The method of claim 46, wherein the base level has a predetermined magnitude and the step of reducing the net charge in response to precursors includes reducing the base level to an amount less than the predetermined magnitude.

52. The method of claim 50, further comprising resetting the base level at the predetermined magnitude until precursors recur.

* * * * *